US009284159B2

(12) United States Patent
Koskelainen

(10) Patent No.: US 9,284,159 B2
(45) Date of Patent: Mar. 15, 2016

(54) EMERGENCY EXIT DOOR OF AN ELEVATOR CAR

(75) Inventor: Kalevi Koskelainen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 619 days.

(21) Appl. No.: 13/474,845

(22) Filed: May 18, 2012

(65) Prior Publication Data

US 2012/0255815 A1 Oct. 11, 2012

Related U.S. Application Data

(63) Continuation of application No. PCT/FI2010/050934, filed on Nov. 18, 2010.

(30) Foreign Application Priority Data

Nov. 18, 2009 (FI) ..... 20090438

(51) Int. Cl.

| | |
|---|---|
| ***B66B 5/00*** | (2006.01) |
| ***B66B 11/02*** | (2006.01) |
| ***B66B 13/24*** | (2006.01) |
| ***B66B 5/02*** | (2006.01) |
| *E06B 3/34* | (2006.01) |
| *E06B 3/50* | (2006.01) |
| *E05F 11/52* | (2006.01) |

(52) U.S. Cl.

CPC ..... *B66B 5/027* (2013.01); *B66B 11/0226* (2013.01); *B66B 13/24* (2013.01); *E05F 11/52* (2013.01); *E06B 3/5009* (2013.01); *E06B 2003/343* (2013.01)

(58) Field of Classification Search

CPC ..... B66B 11/0226; B66B 20/00; B66B 5/00; B66B 19/00; B66B 5/027; E06B 2003/343; E06B 3/5009; E06B 3/5018; E06B 3/50

USPC ..... 187/313, 314, 401; 49/153–155, 233, 49/250

IPC ... B66B 13/24, 20/00, 5/00, 19/00; E05F 11/52

See application file for complete search history.

(56) References Cited

U.S. PATENT DOCUMENTS 2,576,854 A * 11/1951 Peremi et al. ..... 49/141
3,036,346 A * 5/1962 Stake et al. ..... 49/153

(Continued)

FOREIGN PATENT DOCUMENTS

JP 01231788 A * 9/1989 ..... B66B 5/00
JP 2018275 A 1/1990

(Continued)

OTHER PUBLICATIONS

AIPN, Machine Translation, JP 2008063104 A, Apr. 13, 2015, pp. 1-9.*

(Continued)

*Primary Examiner* — William A Rivera
*Assistant Examiner* — Stefan Kruer
(74) *Attorney, Agent, or Firm* — Harness, Dickey & Pierce, P.L.C.

(57) ABSTRACT

The object of the invention is an emergency exit door of an elevator car, in which elevator car the emergency exit door is hinged to at least one wall of the elevator car. The emergency exit door is hinged to a wall of the elevator car to turn around two essentially vertical hinge lines.

13 Claims, 3 Drawing Sheets

(56) References Cited

U.S. PATENT DOCUMENTS

| | | | | | |
|---|---|---|---|---|---|
| 4,388,779 | A * | 6/1983 | Peterson | 49/253 | |
| 5,398,446 | A * | 3/1995 | Kunert | 49/169 | |
| 5,454,449 | A * | 10/1995 | Makimattila et al. | 187/401 | |
| 5,581,942 | A * | 12/1996 | Sill et al. | 49/253 | |
| 8,484,898 | B2 * | 7/2013 | Ohishi | 49/252 | |
| 8,505,240 | B2 * | 8/2013 | Nguyen et al. | 49/252 | |
| 2002/0195297 | A1 * | 12/2002 | Sanchez et al. | 187/401 | |
| 2010/0037526 | A1 * | 2/2010 | Ohishi | E05C 17/16 | 49/326 |
| 2010/0229484 | A1 * | 9/2010 | Carolan et al. | 52/302.1 | |

FOREIGN PATENT DOCUMENTS

| | | | | | |
|---|---|---|---|---|---|
| JP | 02018275 | A * | 1/1990 | B66B 5/00 | |
| JP | 3293279 | A | 12/1991 | | |
| JP | H06-166485 | | 6/1994 | | |
| JP | H11222364 | A | 8/1999 | | |
| JP | 2002265171 | A * | 9/2002 | B66B 11/02 | |
| JP | 2006256733 | A * | 9/2006 | B66B 11/02 | |
| JP | 2008063104 | A | 3/2008 | | |
| JP | 2008063104 | A * | 3/2008 | B66B 5/00 | |

OTHER PUBLICATIONS

International Search Report PCT/ISA/210.

Written Opinion PCT/ISA/237.

Japanese Office Acation dated Jan. 29, 2014 issued in corresponding Japanese Application No. 2012-539374 (with English translation).

Supplementary European Search Report for European Application No. EP10831205.9 Dated Oct. 19, 2015.

* cited by examiner

EMERGENCY EXIT DOOR OF AN ELEVATOR CAR

This application is a continuation of international application PCT/FI2010/050934 filed on Nov. 18, 2010 and claims priority under 35 U.S.C. §120 to FI 20090438 filed on Nov. 18, 2009, the entire contents of each of which are hereby incorporated herein by reference.

BACKGROUND

Known in the art is, among other things, an emergency exit door disposed on a side wall of an elevator car, which emergency exit door is hinged at its top edge and at its bottom edge with pin hinges in the side wall structures of the elevator car. For practical reasons the hinge cannot be disposed exactly on the second edge of the emergency exit door, in which case when turning the door around its hinge line inwards into the elevator car the edge of the door on the other side of the hinge line turns to outside the elevator car. This type of function is not always possible owing to lack of space, e.g. in double-decker elevator cars. Another problem is that a door hinged in this way detracts from the interior decoration of the elevator. An interior decoration panel that is only the width of the door, for example, must always be situated at the point of the door, which interior decoration panel is generally narrower than the other interior decoration panels.

An emergency exit solution is also known from Japanese patent publication no. JP2018275(A), which solution comprises a separate hatch that can be lifted to inside the elevator car, which hatch in normal drive of the elevator is fixed to a side wall of the elevator car. A problem with this solution also is that the hatch disturbs the interior decoration of the elevator. Owing to weight considerations, the hatch cannot be the full height of the wall, in which case the top edge of the hatch bisects the interior decoration panel in the height direction. Additionally, the hatch must comprise lifting handles of large size that are strong enough, for moving the hatch. The lifting handles are also visible in the interior decoration, disturbing the general appearance of the interior decoration.

SUMMARY

Example embodiments are to eliminate the aforementioned drawbacks and to achieve a simple and inexpensive emergency exit door of an elevator car, which can be easily fitted as a part of the interior decoration of an elevator car. In addition, an object is to achieve an emergency exit door that conforms to regulations and that does not cross the exterior line of the outer walls of the elevator car when opening the door.

Example embodiments are also discussed in the descriptive section of the present application. The inventive content of the application can also be defined differently than in the claims presented below. The inventive content may also consist of several separate inventions, especially if the example embodiments are considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each example embodiment can also be applied in other embodiments. In addition it can be stated that at least some of the subordinate claims can at least in some situations be deemed to be inventive in their own right.

One advantage of the emergency exit door solution according to example embodiments is that the interior decoration solutions of an elevator car can be made more freely than before. In this case, it is possible, e.g., to use normal-sized interior decoration panels also at the point of the emergency exit door. The emergency exit door itself can be narrower and shallower than the interior decoration panel fixed to the inner surface of the door, which interior decoration panel is able to turn along with the emergency exit door to inside the elevator car when opening the emergency exit door. Another advantage is that the emergency exit door can be manufactured to be of standard size. A door of the same size and shape is suited to all cars and the interior decoration panels are selected according to the other interior decoration. In this case, an elevator-specific design is omitted, so the design work is speeded up and facilitated. Likewise, the installation work is sped up and facilitated, hence errors do not occur in the installation as easily as before. Another advantage is that the emergency exit door according to example embodiments is also suited to small elevator cars. A further advantage is that complex and expensive adjustment lever systems can be omitted, in which case the solution according to example embodiments is simplier and inexpensive to implement.

BRIEF DESCRIPTION OF THE DRAWINGS

In the following, example embodiments will be described in more detail by the aid of one example of its embodiment with reference to the attached drawings, wherein.

DETAILED DESCRIPTION OF EXAMPLE EMBODIMENTS

Figure 1:
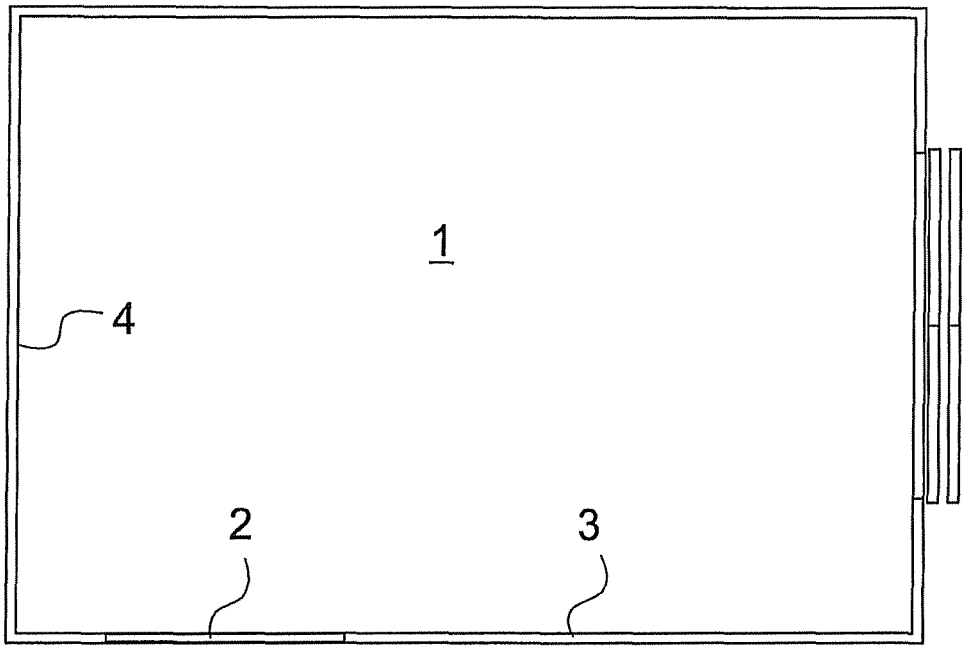
FIG. 1 presents a simplified top view of an elevator car, in which the emergency exit door according to an example embodiment, is closed.
Figure 2:
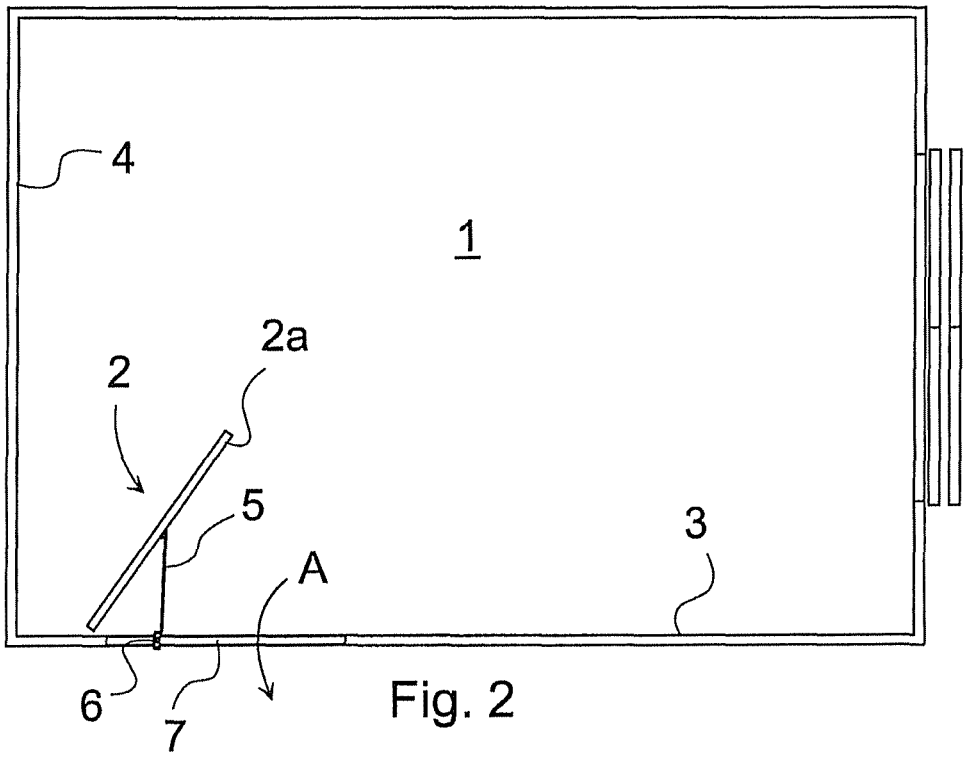
FIG. 2 presents a simplified top view of an elevator car, in which the emergency exit door according to an example embodiment, is open.

FIGS. 1 and 2 present a top view of an elevator car 1, which comprises at least side walls 3 and a rear wall 4. One side wall 3 comprises an emergency exit door 2, which is sunk into the wall structure of the side wall 3 such that the inner surface of the emergency exit door 2 when it is closed is on essentially the same vertical plane as the inner surface of the side wall 3 of the elevator car. If the inner surface of the side wall 3 of the elevator car 1 is e.g. of stainless steel, the inner surface of the emergency exit door 2 also can be of similar stainless steel. If the inside walls of the elevator car 1 are covered with some interior decoration panel, the same type of interior decoration panel can also be fixed to the inside surface of the emergency exit door 2, in which case all of the interior decoration is uniform. In addition, the interior decoration panel fixed to the emergency exit door 2 can be higher and wider than the door and can extend to the side of the emergency exit door 2. Thus on top of the emergency exit door 2 can be e.g. a whole interior decoration panel, which is as large as also the other interior decoration panels of the elevator car. In the case according to the embodiment the emergency exit door 2 is closer to the rear wall of the elevator car 1 than to the front wall.

In FIG. 1 the emergency exit door 2 is closed and in FIG. 2 opened, in which case the door panel 2*a* has been turned into an inclined position around two vertical hinge lines S1 and S2. The hinge lines S1 and S2 are presented in more detail in FIGS. 4 and 5. The emergency exit door 2 comprises a support means 5 that is essentially the height of the door panel 2*a*, which support element is hinged at its first end to the structures of a side wall 3 of the elevator car 1 with pin-type hinges 6 and at its second end to the door panel 2*a*. When the emergency exit door 2 is opened, the side wall 3 of the elevator car 1 contains an opening 7 that functions as an emergency exit, via which passengers are able to exit the elevator car 1 in the direction shown by the arrow A.

Figure 3:
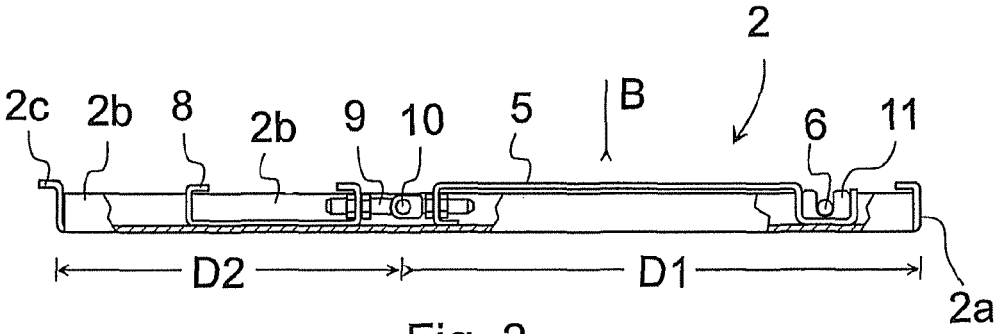
FIG. 3 presents a partially sectioned top view of an emergency exit door according to an example embodiment.
Figure 4:
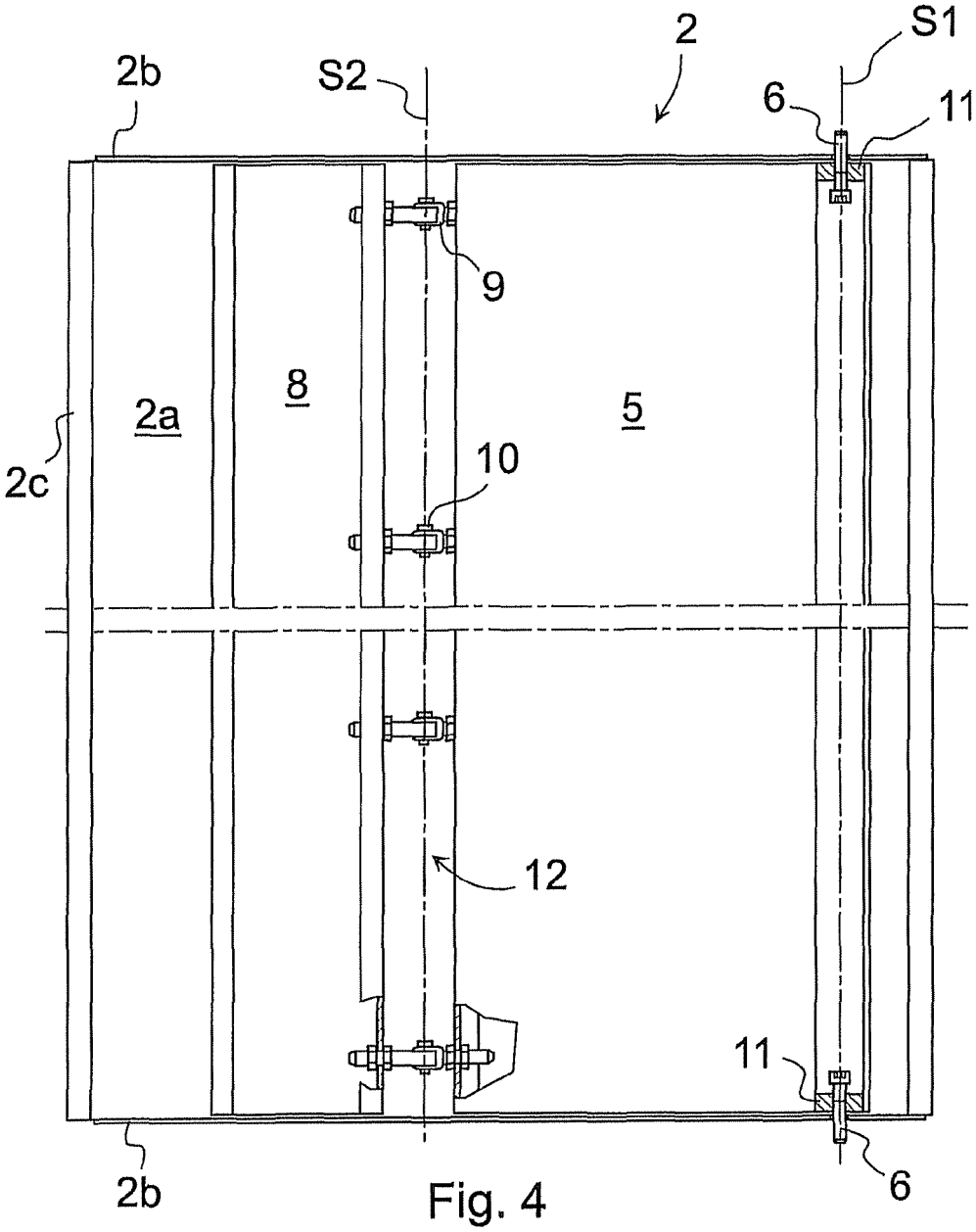
FIG. 4 presents a cut and partially sectioned emergency exit door according to an example embodiment, as viewed from the outside, i.e. as viewed from the direction B of FIG. 3.

In FIGS. 3 and 4 the emergency exit door 2 according to the invention is presented in more detail, disconnected and for the sake of clarity partially sectioned. In FIG. 3 the emergency exit door 2 is presented such that the interior of the door is at the bottom in the figure. Correspondingly, in FIG. 4 the emergency exit door 2 is presented as viewed from the outside, i.e. as viewed from the direction B of FIG. 3. The emergency exit door 2 comprises a door panel 2*a* at least essentially the width of the whole door 2, which door panel is bent from steel plate such that the end edges 2*b* and the side edges of the door panel 2*a* are bent approx. 90° inwards. Both side edges also comprise a second approx. 90° bend, which on the first side edge is towards the center line of the emergency exit door 2 and on the second side edge outwards from the door forming a detent 2*c* that rests on the wall of the elevator car 1.

A channel-type fixing element 8 of C-shaped cross-sectional profile with a straight back is fixed at its rear to the outside of the door panel 2*a*, to an even surface of the door panel 2*a*, the thickness of the cross-section of which fixing element is essentially the same as the thickness of the cross-section of the door panel 2*a*. The fixing element 8 extends essentially from the bottom edge of the door to the top edge of the door such that a small gap remains between the ends of the fixing element 8 and the bendings 2*b* of the ends of the door panel 2*a*. In addition, a support element 5 is hinged to the outside of the door panel 2 by means of screw-type hinges 6 such that one hinge 6 is on the top edge of the door and the other hinge 6 is on the bottom edge of the door. The hinges 6 on the top edge and on the bottom edge between them form a first straight hinge line S1. The hinges 6 are disposed in support pieces 11 that are fixed to a recess in the support element 5. The support pieces 11 contain a hole provided with a screw thread, into which hole screws that function as a hinge 6 are screwed when installing the emergency exit door 2. The wall structure of the side wall 3 of the elevator car 1 comprises support pieces that correspond to the support pieces 11 that are on the top and on the bottom of the door opening 7, into the screw threads in which screws that function as a hinge 6 are further screwed when installing the emergency exit door 2. Thus the height position of the emergency exit door 2 can be adjusted by means of the hinge screws 6.

The support element 5 is a channel-type structure, the thickness of the cross-section of which is essentially the same as the thickness of the cross-section of the door panel 2*a*. Like the fixing element 8, also the support element 5 extends essentially from the bottom edge to the top edge of the door such that a small gap remains between the ends of the fixing element 5 and the bendings 2*b* of the ends of the door panel 2*a*. The support element 5 comprises two channel-type parts in its cross-section, of which the narrower part that is on the first edge of the support element 5 opens outwards from the door and contains the aforementioned support pieces 11, and the wider part on the second edge opens in the opposite direction, i.e. in the direction of the door panel 2*a* in the finished door structure.

The second edge of the support element 5 is at a horizontal distance from the first edge of the fixing element 8, in which case a vertical gap 12 of the door remains between the edges, which gap enables space for a plurality of hinges 9, which are disposed between the fixing element 8 and the support element 5 at a vertical distance from each other. The hinges 9 are fixed at their first end to the second edge of the support element 5 with a bolt-nut fixing, and at their second end to the first edge of the fixing element also with a bolt-nut fixing, which fixing enables horizontal adjustment of the hinges 9. The halves of the hinges 9 are joined together with hinge pins 10, the vertical line of which forms a second hinge line S2.

In order for the emergency exit door 2 to close well and to be easy to open, the ratio of the position of the hinges 9 and of the width of the door panel 2*a* must be suitable. In FIG. 3 the distance from the first edge of the door panel 2*a* to the center line of the hinge pins 10 is marked with the reference D1. Correspondingly, the distance from the second edge of the door panel 2*a* to the center line of the hinge pins 10 is marked with the reference D2. In the case according to the figure the ratio of the distance D1 to the distance D2 is approx. 3/2, i.e. approx. 1.5. The ratio can be of another magnitude also and can differ e.g. such that it is roughly between 1.2 . . . 1.8. Preferably, however, the ratio is e.g. roughly between 1.4 . . . 1.6.

Figure 5:
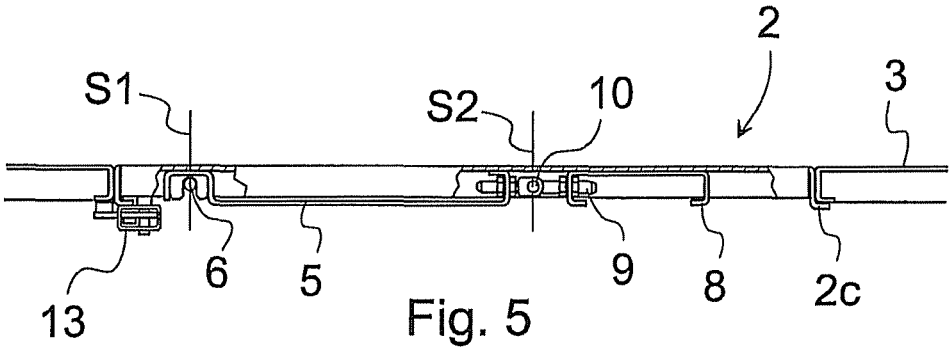
FIG. 5 presents a partially sectioned top view of an emergency exit door according to an example embodiment in the closed position.
Figure 6:
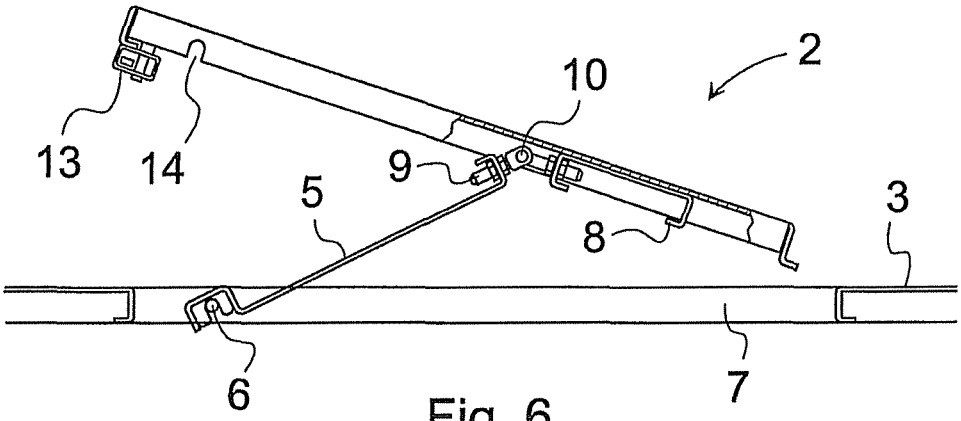
FIG. 6 presents a partially sectioned top view of an emergency exit door according to an example embodiment in the opening phase.
Figure 7:
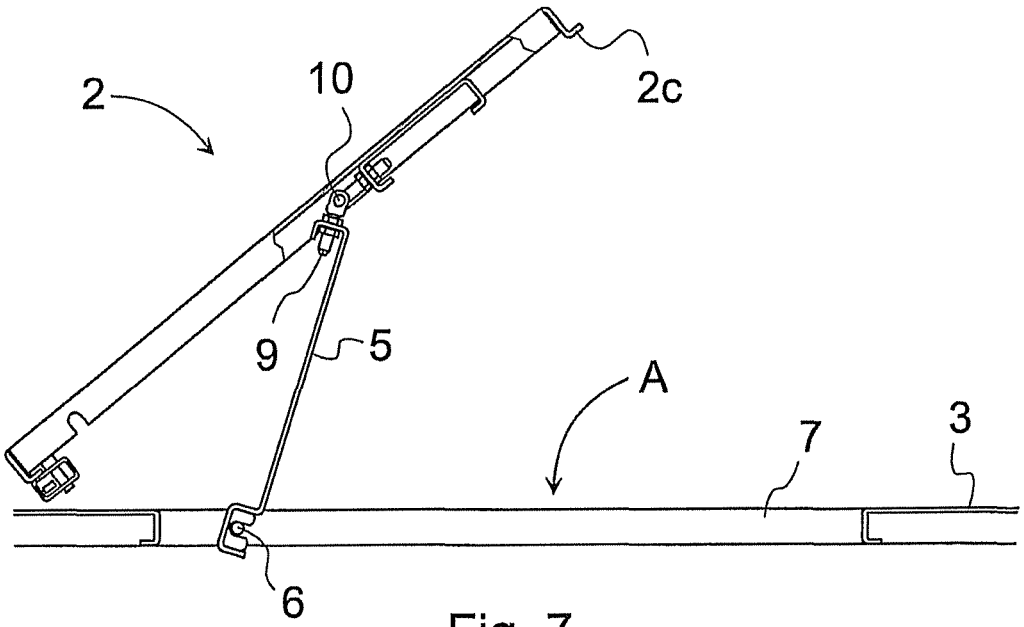
FIG. 7 presents a partially sectioned top view of an emergency exit door according to an example embodiment in the open position.

FIGS. 5-7 present a top view of the operation of an emergency exit door 2 according to the invention. In FIG. 5 the emergency exit door 2 is closed and is in this case locked, by means of a lock 13 operated from inside the elevator car, into its opening 7 in the side wall 3 of the elevator car. In this case the lock 13 on the first edge of the emergency exit door 2 and the detent 2*c* on the second edge of the emergency exit door 2 prevent the emergency exit door 2 from opening by itself inward into the elevator car. Correspondingly, the top edge and the bottom edge of the emergency exit door 2 rest from inside on the detents on the top edge and on the bottom edge of the opening 7 such that the emergency exit door 2 is not able to open outwards. The detents on the top edge and on the bottom edge of the opening 7 are not shown in the figures.

In FIG. 6 the emergency exit door 2 is at the start of its opening phase. The lock 13 is turned into its open position and the edge of the emergency exit door 2 on the lock 13 side is pulled towards the inside part of the elevator car. In this case the emergency exit door 2 starts to retract and to simultaneously turn around both its hinge lines S1 and S2, and to lift away from the opening 7 such that the detent 2*c* is able without obstruction to pass the side edge of the opening 7. When the emergency exit door 2 opens the support element 5 turns around the hinge pins 6 on the stationary hinge line S1 and the emergency exit door 2 turns in relation to the support element 5 around the hinge pins 10 of the hinges 9 on a moving hinge line S2. In FIG. 6 a groove 14 in the end edges 2*b* of the door panel 2 of the emergency exit door 2 is also visible, which groove enables the placement of the emergency exit door 2 in the opening 7 by directing it onto the hinge pin 6 when closing the emergency exit door 2.

In FIG. 7 the emergency exit door 2 is in its open position, in which case between the second edge of the emergency exit door 2 and the second edge of the opening 7 is such a large gap that people can exit from the elevator car in the direction of the arrow A. From FIG. 7 it is seen that the support element 5 has turned counterclockwise around the hinge pins 6, whereas the emergency exit door 2 has simultaneously turned clockwise around the hinge pins 10. In this way, therefore, the support element 5 and the emergency exit door 2 are fitted to turn around their hinges during the same simultaneous movement in opposite directions to each other.

It is obvious to the person skilled in the art that the invention is not limited solely to the example described above, but that it may be varied within the scope of the claims presented below. Thus, for example, the structure of the emergency exit door and hinging can differ to what is presented above.

It is also obvious to the person skilled in the art that the emergency exit door can be disposed in a different point of the elevator car than what is presented above. The emergency exit door can also be on the rear wall of the elevator car or on a side wall closer to the front wall than the rear wall, or also in the center of a side wall.

The invention claimed is:

1. An elevator, comprising:

an emergency exit door connected to at least one wall of an elevator car; and a plurality of hinges defining two vertical hinge lines for pivoting about said respective hinge lines in accordance to a vertical direction of the at least one wall, wherein the emergency exit door is opened by turning simultaneously around the two vertical hinge lines via the plurality of hinges, wherein one set of hinge pins, corresponding to a first hinge line, is parallel to a vertical center line of the emergency exit door, wherein other set of hinge pins, corresponding to a second hinge line, is parallel to a vertical center line of the emergency exit door, and wherein the other set of hinge pins connect halves of respective hinges which extend perpendicular in a direction of the vertical center line of the emergency exit door.

2. The elevator according to claim 1, wherein the emergency exit door comprises a support element having a first end and a second end, the first end is hinged with hinges to the least one wall of the elevator car and the second end is hinged with hinges to a door panel of the emergency exit door.

3. The elevator according to claim 2, further comprising a fixing element, the fixing element is hinged to the support element.

4. The elevator according to claim 3, wherein the fixing element has a C-shaped cross section with a straight back fixed at its rear to an outside of the door panel, to form a flat surface.

5. The elevator according to claim 4, wherein a thickness of the cross section of the fixing element is the same as a thickness of a cross section of the door panel.

6. The elevator according to claim 3, wherein the fixing element is a channel structure.

7. The elevator according to claim 2, wherein the support element is a channel structure.

8. The elevator according to claim 7, wherein the support element includes two channel parts in its cross section, wherein a narrower one of said channel parts is on the first end of the support element and opens outwardly from the door panel, and a wider one of said channel parts is on the second end of the support element.

9. The elevator car according to claim 2, wherein the plurality of hinges of the first end of the support element are fitted to form Han the first hinge line and the plurality of hinges of the second end of the support element are fitted to form the second hinge line.

10. The elevator according to claim 2, wherein the support element is fitted to turn around its hinge line in a direction opposite to a direction of rotation of the door panel.

11. The elevator according to claim 2, wherein a positioning, in a width direction of the emergency exit door, of the hinge pins of the hinges on the door panel is selected to be such that a ratio of a distance from the first end of the door panel to a center line of the hinge pins to a distance from the second end of the door panel to the center line of the hinge pins is approximately between 1.2 to 1.8.

12. The elevator according to claim 2, wherein a positioning, in a width direction of the emergency exit door, of the hinge pins of the hinges on the door panel is selected to be such that a ratio of a distance from the first end of the door panel to a center line of the hinge pins to a distance from the second end of the door panel to the center line of the hinge pins is approximately between 1.4 to 1.6.

13. The elevator according to claim 2, wherein a positioning, in a width direction of the emergency exit door, of the hinge pins of the hinges on the door panel is selected to be such that a ratio of a distance from the first end of the door panel to a center line of the hinge pins to a distance from the second end of the door panel to the center line of the hinge pins is approximately 1.5.

* * * * *